United States Patent [19]

Lewis

[11] 4,122,986

[45] Oct. 31, 1978

[54] PINNING MACHINE

[75] Inventor: Richard W. Lewis, Centerville, Ohio

[73] Assignee: Monarch Marking Systems, Inc., Dayton, Ohio

[21] Appl. No.: 803,013

[22] Filed: Jun. 3, 1977

Related U.S. Application Data

[62] Division of Ser. No. 744,668, Nov. 24, 1976, Pat. No. 4,079,878.

[51] Int. Cl.[2] ..... B65H 23/32

[52] U.S. Cl. ..... 226/198

[58] Field of Search ..... 226/198, 196, 199; 242/76, 157 R

[56] References Cited

U.S. PATENT DOCUMENTS

| | | | |
|---|---|---|---|
| 2,054,586 | 9/1936 | Mayer | 226/198 X |
| 3,572,918 | 3/1971 | Steisslinger | 226/198 X |

*Primary Examiner*—Richard A. Schacher
*Attorney, Agent, or Firm*—Joseph J. Grass

[57] ABSTRACT

There is disclosed a pinning machine having an improved plunger, an improved guide track and an improved knife assembly. The plunger has relatively movable sections threadably connected together to enable the length of the plunger to be changed so that tags can be pinned to different thicknesses of merchandise by changing the plunger length. The guide track includes a one-piece leaf spring which acts against one edge of a web of record members to urge the other side of the web against an edge guide. The spring is resiliently held in captivity in a recess without being secured in the recess as by fasteners. The knife assembly includes a pair of fixed knives separated by a gap and a movable knife guided by guide means in the gap. The movable knife is floatingly or loosely mounted so that the guide means is the sole means for guiding the movable knife relative to the fixed knives.

3 Claims, 16 Drawing Figures

PINNING MACHINE

CROSS-REFERENCE TO RELATED APPLICATION

This is a division of copending application Ser. No. 744,668, filed Nov. 24, 1976, now U.S. Pat. No. 4,079,878.

BACKGROUND OF THE INVENTION

1. Field of the Invention

This invention relates to the art of pinning machines, knife assemblies and guide tracks.

2. Brief Description of the Prior Art

U.S. Pat. No. 1,667,810 to Kohnle dated May 1, 1928 discloses a pinning machine having a cam driven, spring-containing plunger and a knife assembly having knife blades 84 and 87.

U.S. Pat. No. 2,438,118 to Flood et al dated Mar. 23, 1948 discloses a pinning machine having a knife assembly with a knife rigidly secured to a cam driven bell crank lever rockable about a stud shaft. The plunger is driven by adjustably connected levers, one of which carries a cam follower received in a cam track and the other of which in directly coupled to the plunger.

SUMMARY OF THE INVENTION

According to the invention, there is disclosed a knife assembly in which a pair of fixed knives spaced apart by a gap are cooperable with a movable knife which moves in the gap. The movable knife is guided for movement in alignment with the gap. The movable knife is floatingly or loosely mounted so that its movement is controlled by the guide means and not by the mounting means. It is preferred that the guide means be provided by an extension or tang on the movable knife, and the tang is guided for movement in the gap. The movable knife is preferably mounted in a movably mounted knife holder having shaft or post means received in oversize holes in the movable knife. The relationship between the holes and the post means enables the movable knife to cant away from the perpendicular with respect to the post means under the control of the guide means. It is preferred to resiliently hold the knife in the holder so that knife clatter is obviated. The movable knife is removably mounted to the holder so that a worn knife can be readily sharpened or replaced.

It is another feature of the invention to provide a pinning machine of the type having an anvil and a cooperable plunger with an arrangement by which an operator can quickly change over the machine to pin tags to various thicknesses of merchandise. This is accomplished by changing the length of the plunger so that when the plunger is actuated the amount of clearance between the plunger and the anvil (when the plunger and the anvil are in complete cooperation) can be varied. In the preferred arrangement the operator simply rotates one part of the plunger through 360° to either lengthen or shorten the plunger. If for example the length of the plunger is set to pin tags to thin merchandise such as delicate lingerie and it is now desired to pin tags to thick merchandise such as heavy denim jeans, then the plunger length should be shortened by rotating one of the parts of the plunger relative to another of the plunger parts, and vice versa. It is preferred that the plunger parts be threadably adjustably secured to each other so that rotation of the parts relative to each other results in lengthening or shortening of the plunger. It is also a feature that the plunger be lengthened or shortened in stages. As an operator becomes familiar with the adjustment range of the plunger the operator will know how to adjust the plunger quickly by determining from experience the number of complete revolutions of the plunger that are required to adjust from one thickness of merchandise to another. The plunger parts are preferably rotated relative to each other through 360° so that a pin guide groove in the upper end of the plunger is always correctly oriented relative to a pin driver. It is preferred to use a spring-urged detent cooperable with a groove so that when the operator senses that the plunger has been brought to an initial or home position the operator will know that the pin guide groove of the plunger is correctly oriented. The plunger is guided for reciprocal movement in a guide or barrel. It is preferable that the upper part of the plunger is the rotatable part so that the operator can adjust the plunger by manually grasping and rotating that portion of the upper part of the plunger which projects above the barrel.

It is another feature of the invention to provide a guide track having a one-piece leaf spring held captive in a recess and arranged to act on an edge of a web or sheet to urge the web or sheet against an edge guide.

DETAILED DESCRIPTION OF THE PREFERRED EMBODIMENT

Figures 1, 2, 3, 4, 5, 6, 7:
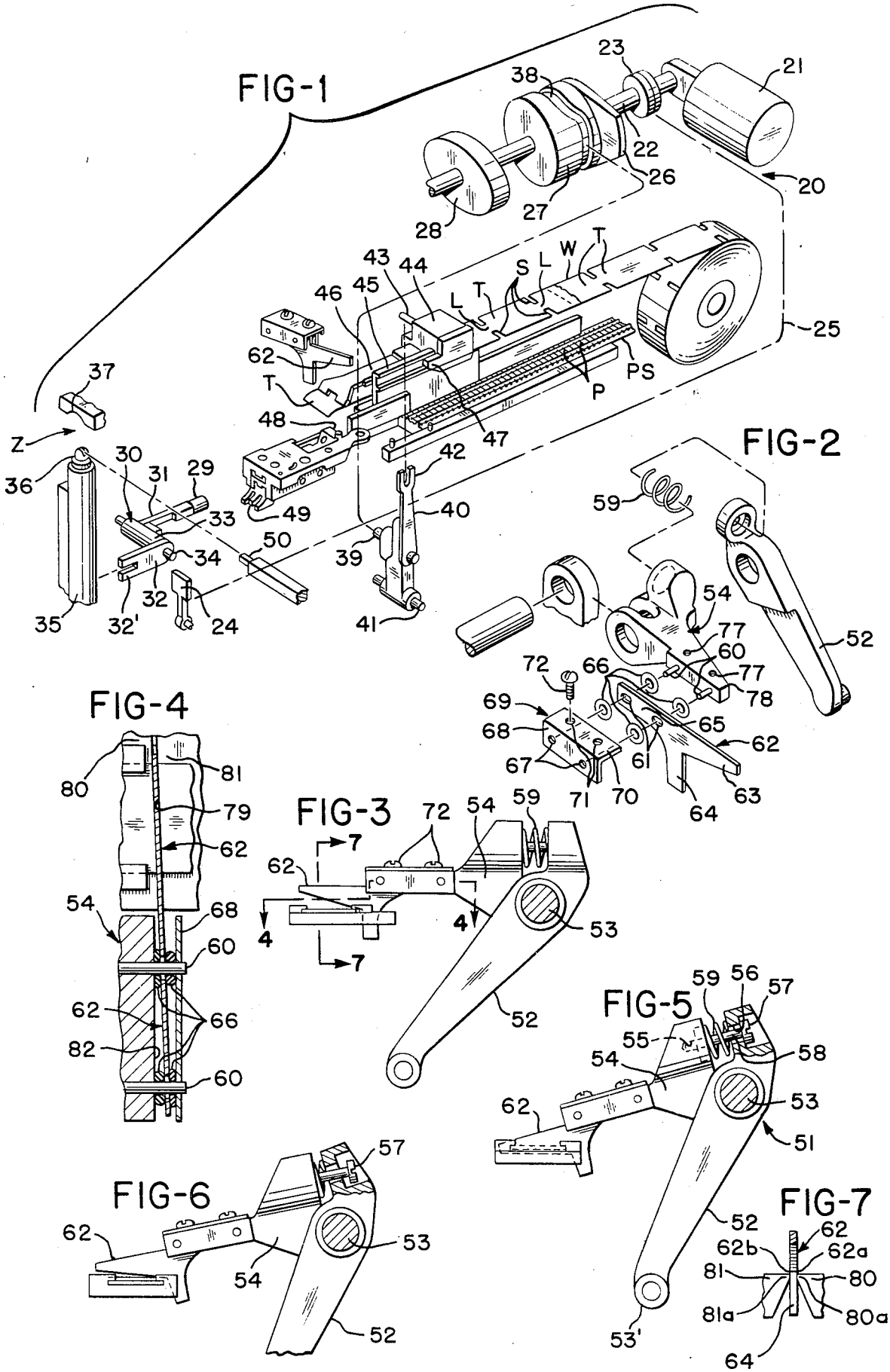
FIG. 1 is an exploded perspective diagrammatic view of major components of a pinning machine incorporating the invention.
FIG. 2 is an exploded perspective view of a knife assembly of the machine.
FIG. 3 is a side elevational view of the knife assembly showing the movable knife in the non-cutting position.
FIG. 4 is a sectional view taken along line 4—4 of FIG. 3.
FIG. 5 is a side elevational view similar to FIG. 3 but showing the movable knife in the cutting position.
FIG. 6 is a view similar to FIG. 5 but showing components of the knife assembly moving relative to each other upon the movable knife encountering excessive resistance.
FIG. 7 is a sectional view taken along line 7—7 of FIG. 3.
Figure 8:
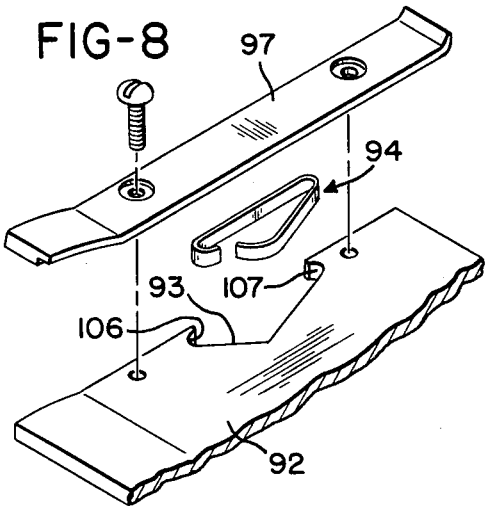
FIG. 8 is a fragmentary exploded perspective view of a guide track.

With reference to FIG. 1 in which there is shown an exploded fragmentary view of a pinning machine generally indicated at 20, the machine 20 has an electric motor 21 for driving a cam shaft 22 through a single revolution clutch 23. The clutch 23 is tripped or cycled once by a manually operable actuator or paddle 24 which is shown to be coupled to the clutch 23 as indicated by phantom lines 25. Cams 26, 27 and 28 are fixed to the shaft 22 and rotate through a single revolution each time the clutch 23 is operated to drive components of the machine 20 through a machine cycle. The cam 26 drives a roller follower 29 carried by a pivotally mounted lever generally indicated at 30. The lever 30 includes a pair of arms 31 and 32 fixedly secured to a sleeve 33. The arm 32 has a bifurcated portion 32'. The sleeve 33 is pivotally mounted on a pivot 34. A barrel or guide 35 mounts a plunger 36 for reciprocal movement. The plunger 36 is coupled to the bifurcated portion 32' of the arm 32. The plunger 36 is cooperable with the anvil 37 at a pinning zone Z at which a tag T and merchandise (not shown) are held in a bent orientation.

The cam 27 has a cam groove 38 which receives a roller follower 39. The roller follower 39 is carried by a pivotally mounted arm 40 mounted on a pivot 41. The arm 40 has a bifurcated portion 42 which receives a pin 43 carried by a slide 44. The slide 44 is guided for reciprocal movement on a guide 45. The slide 44 carries a feed finger 46 which is used to advance the tag T to the pinning zone Z. The slide 44 carries an actuator 47 which contacts an actuated member 48 to advance a feed claw 49. The feed claw 49 advances during each cycle of the cam machine to advance the pin strip PS. The pin strip PS carries a plurality of pins P. As the pin striped PS is advanced the leading pin P is brought into a pin driving position relative to a pin driver 50.

The cam 28 drives a knife assembly or cutting mechanism generally indicated at 51. The knife assembly is shown to include a lever 52 pivotally mounted on a shaft 53 and carries a follower roller 53' driven by the cam 28. The knife assembly 51 is also shown to include a knife holder or lever 54 pivotally mounted on the shaft 53. The holder 54 has a threaded bore 55. The lever 52 contains a hole 56. Head 57 of a bolt 58 bears against the lever 52 and the bolt 58 passes through the hole 56 and is threadably received in the threaded bore 55. A compression spring 59 is received about the bolt 58 and bears at one end against the lever 52 and at the other end against lever 54. With reference to FIG. 2 the holder 54 is shown to have a pair of parallel posts or studs 60. The posts 60 pass through enlarged or oversize holes 61 in a movable knife 62. The knife 62 has a blade portion 63, an extension or tang 64 and a shank portion 65 which contains the holes 61. Pairs of O-rings 66 received on the posts 60 straddle the shank portion 65 adjacent the holes 61. The posts 60 also extend through holes 67 in arm 68 of an angle-shaped bracket generally indicated at 69. The bracket 69 also has an arm 70 with a pair of holes 71 which receive threaded fasteners 72 threadably received in threaded holes 77 in body 78 of the holder 54. The holes 67 are axially aligned with the posts 60. There is a relatively close fit between the posts 60 and the holes 67 so that when the bracket 69 is in place both end portions of the posts 60 are secured. The holes 61 are also axially aligned with the posts 60 but are sufficiently large in dimension to enable the knife 62 to skew relative to the posts 60 as shown exaggeratedly in FIG. 4. The knife 62 is shown to be received in a gap 79 between a spaced-apart pair of knives 80 and 81. The tang or extension 64 is in guided relationship with the end faces of the knife so that the knife 62 is always guided by the tang 64 in alignment with the gap 79. The O-rings 66 resiliently yield to allow the guide 64 to control the position of the knife 62. As also shown in FIG. 4 the leg portion 68 is parallel to wall 82 of the holder 54, and the posts 60 are shown to be perpendicular to the leg portion 68. The O-rings 66 are shown to be under different states of compression in FIG. 4. It is readily apparent that the knife 62 can cant with respect to the perpendicular relative to the posts 60, in that the knife 62 is loosely or floatingly mounted on the posts 60. The holes 61 in the shank portion 65 of the knife 62 can be of any desired shape for example they can be elongated slots, so long as the knife 62 is permitted to function in the manner indicated above. By an alternative construction (not shown) the knife 62 can be provided with integrally formed posts or studs which can be floatingly or loosely received in the holder to accomplish the same purpose or the knife 62 can be mounted in the holder in any suitable manner to accomplish the foregoing coaction. As is preferred the knife 62 is a blanking knife which means that the knife has opposed edges **62*a* and 62*b* which cooperate respectfully with knives of knife edges 80*a* and 81*a* of the respective support surfaces 80 and 81, although the invention is not limited to the use of a blanking knife. The web W of tags T is provided with lands L disposed between the ends of laterally aligned slots S. The cooperating knives 62, 80 and 81 sever lands L between lateral aligned slots S to provide rectangularly-shaped blanks or chad so that the severed tag is rectangular. In the event the knife 62 encounters undue resistance the spring 59 will yield as indicated in FIG. 6 to prevent damage to the machine 20**.

With respect to FIGS. 8 through 11, there is shown track structure generally indicated at 90 for guiding the web W of tags T. There is shown a base or mounting plate 91 on which a guide plate 92 is disposed. The guide plate 92 has a cutout 93 which receives a leaf spring generally indicated at 94. The leaf spring 94 is wider than the thickness of plate 92 as shown for example in FIG. 11. A guide member 95 is secured to the base plate 91 by threaded fasteners 96 and the guide member 97 spaced from the guide member 95 is secured to the base plate 91 by threaded fasteners 98. The threaded fasteners 96 pass through the guide plate 92 and help to clamp guide plate 92 to the base plate 91. The spring 94 urges one side edge S1 against guide edge 99 of the guide member 95. The guide member 95 also has an overhang 100 which holds down the web W. The guide member 97 has an overhang 101 which helps hold down the web W.

Figure 9:
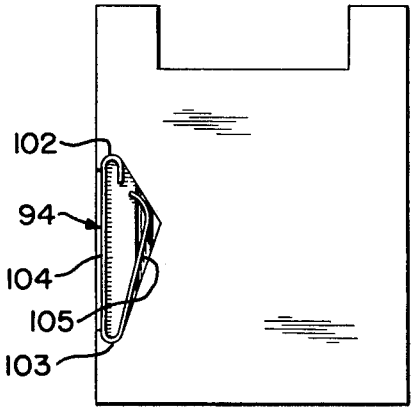
FIG. 9 is a bottom plan view of the guide track absent any web in the track.
Figure 10:
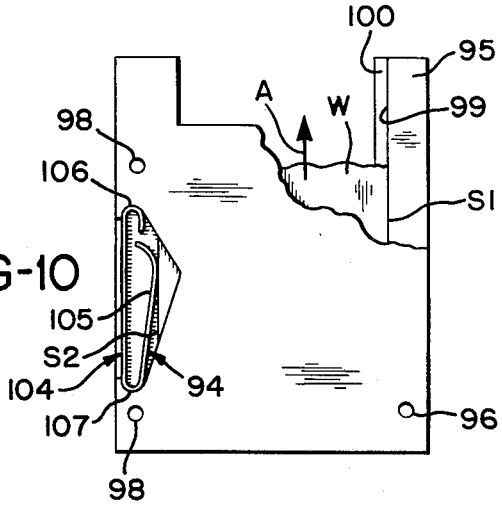
FIG. 10 is a view similar to FIG. 9 but showing a web being guided in the track.
Figure 11:
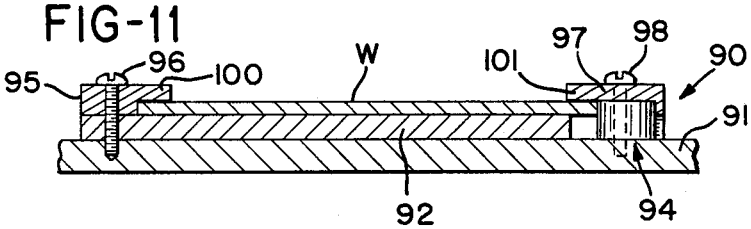
FIG. 11 is a sectional view through the track.

The web W moves in the direction of arrow A as shown in FIG. 10. The spring 94 is of one-piece construction and has a pair of U-shaped portions 102 and 103. An elongated portion 104 is joined to the one ends of the U-shaped portions 102 and 103 and a finger or finger portion 105 is joined to one of the other ends of the U-shaped portion 103. The finger portion 105 is movable relative to the portion 104. FIG. 9 illustrates the finger 105 in its fully extended position, because there is no web in the track structure, whereas FIG. 10 shows the finger 105 in contact with side edge S2 of the web W. The finger 105 acting on the side edge S2 urges the side edge S1 into contact with the surface 99 so that the web W always extends in a predetermined path. The undercut cutout 93 is shown to have a pair of recesses 106 and 107. The U-shaped portion 102 is nested in the recess 106 whereas the U-shaped portion 103 is nested in the recess portion 107. The distance between the outer surfaces of the U-shaped portions 102 and 103 in their free state is slightly greater than the distance between the recesses 106 and 107 so that the spring 94 is resiliently held in the cutout 93, and yet the finger 105 is free to flex so that it is always in urging contact with the web W. It is apparent that no auxiliary fasteners are required to hold the springs 104 in position. The spring 94 is held captive in the cutout 93. The spring 94 is positioned between guide member 97 and the base plate 91.

Figure 12:
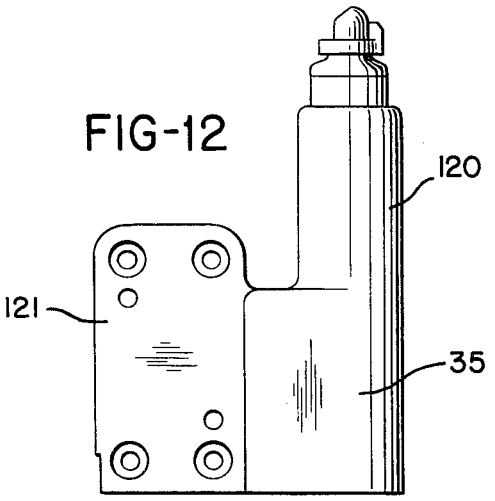
FIG. 12 is a front elevational view of a plunger and barrel for the pinning machine.
Figure 13:
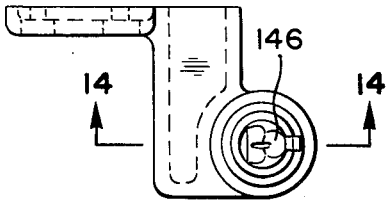
FIG. 13 is a top plan view of the plunger and barrel shown in FIG. 12.
Figure 14:
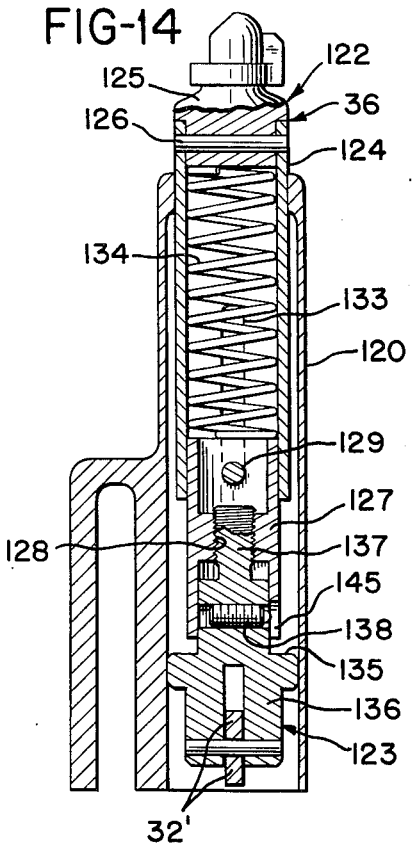
FIG. 14 is an enlarged sectional view taken along line 14—14 of FIG. 13.
Figure 15:
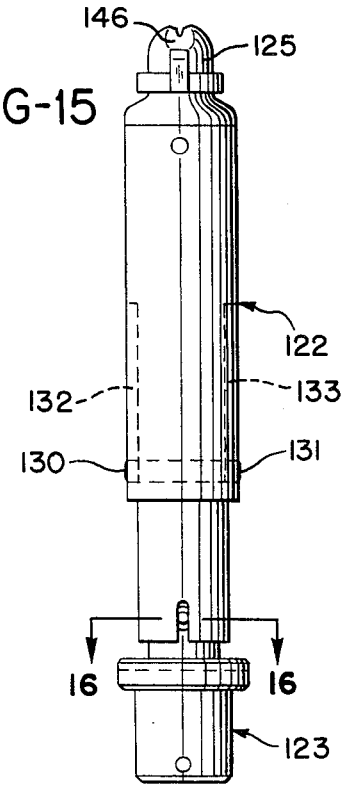
FIG. 15 is a right side elevational view of the plunger shown in FIG. 14.
Figure 16:
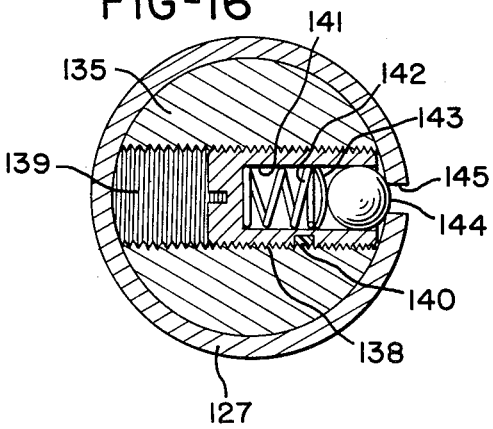
FIG. 16 is an enlarged sectional view taken along line 16—16 of FIG. 15.

With reference to FIG. 12 the barrel 35 is shown to have a barrel portion 120 cast integrally with a mounting flange portion 121. The mounting flange portion 121 is secured to the frame (not shown) of the machine 20 as by screws (not shown). The plunger 36 is shown to include relatively movable parts or components generally indicated at 122 and 123. The part 122 is shown to include a tube 124, a plunger member 125 which extends into the tube 124 and is secured to the tube 124 by a pin 126, a connector 127 having an internally threaded bore 128, and a pin 129 secured to the connector 127 and having ends 130 and 131 which extend through opposed elongated slots 132 and 133 in the tube 124. The connector 127 is slidably received by the inside surfaces of the tube 124. The part 122 also includes compression spring 134 which bears at one end of the plunger member 125 and at the other end against the connector 127. The spring 134 is adapted to yield when the plunger 36 encounters undue resistance at the pinning zone Z. The tube 124, the plunger member 125, the pin 126, the connector 127, the pin 129 and the spring 134 can be considered to be one part or subassembly in that the part 122 is rotatable as unit relative to the part 123. The part 123 is shown to include a connector 135 having a clevis or clevis portion 136, a threaded portion 137 threadably received in the threaded bore 128, and a detent 138 threadably received by the connector 135. The detent 138 is shown in detail in FIG. 16. The detent 138 is threadably received in a through hole 139 and is held in place by a plastic locking member 140. The detent 138 includes a cavity or recess 141 for receiving a compression spring 142, a dish-shaped washer 143 and a ball 144. The ball 144 is shown to cooperate with a longitudinally extending groove 145 in the connector 127. The detent 138 and the groove 145 are so positioned that guide groove 146 in the plunger member 125 is correctly aligned with pin driver 50 when ball 144 cooperates with the groove 145. In the event the operator desires to change the length of the plunger 36 for pinning a tag T to a different thickness of merchandise, the operator grasps the portion of the plunger 36 which extends above the barrel portion 120 and rotates it through 360° or through a multiple of 360° in either one direction or in the opposite direction to either lengthen or shorten the plunger 36. When as for example a tag T is to be pinned to thick merchandise the plunger 36 is rotated in the direction which will shorten the plunger 36. In so doing the entire part 122 rotates relative to the part 123. The shortened plunger 36 will now rise to a final but lower level relative to the anvil 37.

Other embodiments and modifications of this invention will suggest themselves to those skilled in the art, and all such of these as come within the spirit of this invention are included within its scope as best defined by the appended claims.

I claim:

1. A guide track, comprising: a base plate, a guide plate mounted on the base plate, a first guide mounted on the guide plate, first the guide having an overhanging portion spaced from the guide plate, a second guide spaced from the first guide, the second guide having an overhanging portion spaced from the guide plate, the guide plate being adapted to support a sheet or web and the first guide being adapted to guide an edge of the sheet or web, the guide plate having an undercut recess, and a leaf spring resiliently held captive in the recess without the aid of fasteners, the spring having a pair of U-shaped portions, an elongated portion joined to one of the legs of the U-shaped portions and a spring finger joined to the other leg of one of the U-shaped portions, the finger being disposed in opposed relation to the first guide and being adapted to contact the other edge of the sheet or web, the spring being disposed between the base plate and the second guide.

2. Apparatus for guiding the edge of a sheet or web, comprising: means providing an undercut recess, and a leaf spring resiliently held captive in the recess without the aid of fasteners, the spring having a pair of U-shaped portions, an elongated portion joined to one of the legs of the U-shaped portions and a spring finger joined to the other leg of one of the U-shaped portions, the finger extending beyond the recess and being adapted to contact an edge of the sheet or web.

3. A guide track, comprising, a guide, means providing an undercut recess, and a leaf spring resiliently held captive in the recess without the aid of fasteners, the spring having a pair of U-shaped portions, an elongated portion joined to one of the legs of the U-shaped portions and a spring finger joined to the other leg of one of the U-shaped portions, the finger being disposed in opposed relation to the guide and being adapted to contact the other edge of the sheet or web.

* * * * *